US007267918B2

(12) United States Patent
Shibai et al.

(10) Patent No.: US 7,267,918 B2
(45) Date of Patent: Sep. 11, 2007

(54) TONER AND METHOD OF MANUFACTURING TONER

(75) Inventors: Yasuhiro Shibai, Yamatokoriyama (JP); Satoru Ariyoshi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 300 days.

(21) Appl. No.: 10/867,841

(22) Filed: Jun. 16, 2004

(65) Prior Publication Data

US 2004/0259017 A1 Dec. 23, 2004

(30) Foreign Application Priority Data

Jun. 20, 2003 (JP) ..... 2003-177165

(51) Int. Cl.
*G03G 9/08* (2006.01)

(52) U.S. Cl. ..... 430/108.1; 430/137.1

(58) Field of Classification Search ..... 430/137.1, 430/108.1

See application file for complete search history.

(56) References Cited

U.S. PATENT DOCUMENTS

| | | | | |
|---|---|---|---|---|
| 5,716,748 | A * | 2/1998 | Hasegawa et al. | 430/111.2 |
| 6,337,169 | B1 * | 1/2002 | Hashimoto et al. | 430/126 |
| 6,808,855 | B2 * | 10/2004 | Ayaki et al. | 430/110.2 |

FOREIGN PATENT DOCUMENTS

| | | | |
|---|---|---|---|
| JP | 60-186854 | | 9/1985 |
| JP | 60-186862 | A | 9/1985 |
| JP | 60-186868 | A | 9/1985 |
| JP | 64-059239 | | 3/1989 |
| JP | 1-257853 | A | 10/1989 |
| JP | 02-105162 | | 4/1990 |
| JP | 05-034965 | | 2/1993 |
| JP | 6-75429 | A | 3/1994 |
| JP | 7-140700 | A | 6/1995 |
| JP | 7-209911 | A | 8/1995 |
| JP | 09-043893 | | 2/1997 |
| JP | 6-62133 | A | 3/1997 |
| JP | 09-281742 | | 10/1997 |
| JP | 10-48883 | A | 2/1998 |
| JP | 10-104880 | A | 4/1998 |
| JP | 11-258841 | A | 9/1999 |
| JP | 11-338183 | A | 12/1999 |
| JP | 2002-40715 | A | 2/2002 |

OTHER PUBLICATIONS

Japanese Office Action mailed Jun. 14, 2005 in corresponding Japanese application No. 2003-177165 "Shin-Etsu Silicone Oil" Catalogue, Shin-Etsu Chemical Co., Ltd., Sep. 2003, pp. 3 and 10-11.

* cited by examiner

*Primary Examiner*—John L Goodrow
(74) *Attorney, Agent, or Firm*—Nixon & Vanderhye P.C.

(57) ABSTRACT

Cross-linked type organic fine particles are used as organic fine particles having a core-shell structure to be attached to a base particle, and the cross-linking degree of the core part is made higher than that of the shell part. A toner is manufactured by mixing cross-linked type organic fine particles having a core-shell structure with a solution containing a neutralizer, dispersing a composition for forming a base particle, which contains a releasing agent and a colorant, into the solution in which the organic fine particles are mixed, and separating the composition from the solution.

12 Claims, 3 Drawing Sheets

FIG. 3A

| TONER | KIND OF ORGANIC FINE PARTICLE | STRUCTURE OF ORGANIC FINE PARTICLE | SIZE OF ORGANIC FINE PARTICLE (nm) | SWELLING RATE OF FINE PARTICLE | Rg/Ra |
|---|---|---|---|---|---|
| T-1 | MG-1 | CORE-SHELL/CROSS-LINK | 102 | 1.55 | 1.03 |
| T-2 | MG-1 | CORE-SHELL/CROSS-LINK | 102 | 1.55 | 1.05 |
| T-3 | MG-1 | CORE-SHELL/CROSS-LINK | 102 | 1.55 | 1.09 |
| T-4 | MG-1 | CORE-SHELL/CROSS-LINK | 102 | 1.55 | 1.12 |
| T-5 | MG-2 | CORE-SHELL/CROSS-LINK | 38 | 1.29 | 1.04 |
| T-6 | MG-3 | CORE-SHELL/CROSS-LINK | 25 | 1.52 | 1.03 |
| T-7 | MG-4 | CORE-SHELL/CROSS-LINK | 95 | 1.54 | 1.05 |
| T-8 | MG-5 | CORE-SHELL/NON-CROSS-LINK | 98 | 1.97 | 1.05 |
| T-9 | MG-6 | CORE-SHELL/CROSS-LINK | 120 | 1.50 | 1.04 |
| T-10 | MG-7 | CORE-SHELL/CROSS-LINK | 270 | 1.25 | 1.06 |
| T-11 | MG-8 | CORE-SHELL/CROSS-LINK | 350 | 1.38 | 1.04 |
| T-12 | MG-9 | SINGLE/CROSS-LINK | 255 | 1.02 | 1.03 |
| T-13 | — | — | — | — | 1.00 |

FIG. 3B

| FIXING ABILITY EVALUATION (℃) | DURABILITY EVALUATION | CHARGING STABILITY | TRANS-PARENCY | TOTAL EVALU-ATION |
|---|---|---|---|---|
| 120~200/◎ | ○ | 83/◎ | 15/◎ | ○ |
| 120~210/◎ | ◎ | 80/◎ | 17/◎ | ◎ |
| 130~200/○ | ◎ | 75/○ | 20/◎ | ○ |
| 130~190/○ | ◎ | 82/○ | 24/○ | ○ |
| 130~200/◎ | ◎ | 81/◎ | 16/◎ | ◎ |
| 130~190/○ | ○ | 82/◎ | 15/◎ | ○ |
| 120~210/◎ | ◎ | 75/○ | 19/◎ | ◎ |
| 120~210/◎ | × | 80/◎ | 20/◎ | × |
| 120~200/◎ | ○ | 75/○ | 16/◎ | ○ |
| 130~190/○ | ◎ | 84/◎ | 21/○ | ◎ |
| 130~200/○ | ◎ | 85/◎ | 25/○ | ○ |
| 150~170/× | × | 80/◎ | 23/○ | × |
| 120~210/◎ | × | 62/× | 16/◎ | × |

TONER AND METHOD OF MANUFACTURING TONER

CROSS-REFERENCE TO RELATED APPLICATION

This non-provisional application claims priority under 35 U.S.C. §119(a) on Patent Application No. 2003-177165 filed in Japan on Jun. 20, 2003, the entire contents of which are hereby incorporated by reference.

BACKGROUND OF THE INVENTION

The present invention relates to a toner produced by attaching fine particles to a base particle and a manufacturing method of the toner, and more particularly relates to a toner necessary for an electrophotographic technique used in image forming apparatuses such as copying machines and printer machines and a method of manufacturing the toner.

Image forming apparatuses such as copying machines and printer machines use an electrophotographic technique in which an image is formed by uniformly charging a photosensitive drum, forming an electrostatic latent image on the charged photosensitive drum by scanning an optical image based on the image to be formed, performing development to turn the formed electrostatic latent image into a visible image by attaching a powder toner containing a colorant to the electrostatic latent image, transferring the obtained visible image onto a sheet such as copy paper, and fixing the transferred toner to the sheet.

Typical examples of a method of fixing a toner to a sheet include a heat fixing method in which a toner is fixed to a sheet such as copy paper by heating and melting the toner; and a pressure fixing method in which the composition of a toner is deformed by pressing the toner, and the toner is fixed to a sheet. As the heat fixing method, from the point of view of simplicity of the machine and the quality of images after fixed, a heat roll fixing method using a heat roll as a heating medium for heating the toner is the most popular method. In the heat fixing method, it is necessary to fix the toner onto a sheet by melting the toner at a low temperature. In particular, there is high demand for low-temperature fixing ability of the toner from the point of view of saving energy in recent years, and the demand for low-temperature fixing ability is satisfied by lowering the softening temperature by decreasing the molecular weight of a resin contained in the toner and adding a wax.

However, although the method including decreasing the molecular weight of the resin and adding a wax has the advantageous effect on the low-temperature fixing ability, it has problems of deterioration of storage stability and durability during long-time running. Therefore, various methods have been proposed to satisfy both the low-temperature fixing ability and the storage stability and durability by attaching fine particles to the surface of a base particle that becomes a toner.

As one of these methods, there is disclosed a method in which non-cross-linked type organic fine particles manufactured by a soap-free emulsion polymerization method are externally added (for example, Patent Document 1: Japanese Patent Application Laid-Open No. 60-186854/1985). Moreover, there is disclosed a method in which non-cross-linked type organic fine particles having a core-shell structure are externally added (for example, Patent Document 2: Japanese Patent Application Laid-Open No. 9-281742/1997). Further, there is disclosed a method in which fine particles having the opposite polarity to the surface of the base particle are electrically attached (for example, Patent Document 3: Japanese Patent Application Laid-Open No. 64-59239/1989, and Patent Document 4: Japanese Patent Application Laid-Open No. 2-105162/1990).

However, the toners manufactured by the methods shown in Patent Document 1 and Patent Document 2 have the problem of insufficient durability, and, if the amount of addition of the fine particles is increased to solve the problem associated with durability, there arises the problem that the oozing effect of wax in oil-less fixing is reduced and the offset resistance is decreased.

Further, the toners manufactured by the methods shown in Patent Document 3 and Patent Document 4 have the problem of deterioration of chargeability because they have a functional group that is charged to the polarity opposite to the base particle.

BRIEF SUMMARY OF THE INVENTION

The present invention has been made with the aim of solving the above problems, and it is an object of the present invention to provide a toner which is manufactured by attaching organic fine particles having a core-shell structure to a base particle, can achieve improved durability and storage stability without increasing the amount of addition of the fine particles by using cross-linked type organic fine particles, and can have excellent chargeability by causing the shell part of the organic fine particles to contain an ionic functional group, and provide a manufacturing method of the toner.

A toner of the present invention is a toner manufactured by attaching organic fine particles having a core-shell structure and a smaller particle size than a base particle to the base particle, wherein the organic fine particles are of cross-linked type.

In the toner of the present invention, by using cross-linked type organic fine particles as organic fine particles having a core-shell structure to be attached to the base particle, it is possible not only to provide excellent low-temperature fixing ability, but also to improve the durability and storage stability even with a small amount of addition of the organic fine particles compared to non-cross-linked type organic fine particles, and it is also possible to prevent a decrease in the offset resistance due to reduction of the oozing effect of a releasing agent (wax) in oil-less fixing because there is no need to increase the amount of addition of the fine particles.

In the toner of the present invention, the cross-linking degree of the shell part of the organic fine particles is lower than that of the core part thereof. In the toner of the present invention, by increasing the cross-linking degree of the core part, the shell part can form a micro domain and improve the durability. Besides, since the cross-linking degree of the shell part is low, it is possible to promote fusion between the organic fine particles and the base particle and between the organic fine particles, thereby maintaining the durability during long-time running. In addition, the shell part is softened during fixing and the releasing agent oozes out onto the surface along the shell structure, thereby improving the offset resistance.

In the toner of the present invention, the shell part of the organic fine particles contains an ionic functional group. In the toner of the present invention, by causing the shell part of the organic fine particles to contain an ionic functional group, it is possible to improve the chargeability.

In the toner of the present invention, the particle size of the organic fine particles is increased by 1.2 times or more by neutralizing the ionic functional group. In the toner of the present invention, since the organic fine particles swell by neutralizing the ionic functional group of the organic fine particles, it is possible to promote fusion between the organic fine particles and the base particle and between the organic fine particles and to improve the durability during long-time running. In particular, fusion is significantly promoted when the particle size increases by 1.2 times or more.

In the toner of the present invention, the organic fine particles have a particle size of 30 to 300 nm before neutralization. In the toner of the present invention, by controlling the particle size before neutralization to be 30 nm or larger, it is possible to improve the durability, and, by controlling the particle size before neutralization to be 300 nm smaller, it is possible to improve the low-temperature fixing ability and transparency.

In the toner of the present invention, the organic fine particles are produced by soap-free emulsion polymerization. In the present invention, by producing a toner by soap-free emulsion polymerization in which an emulsifier is immobilized in the organic fine particles, bleed to the toner surface is reduced, and it is possible to prevent a decrease in the charging stability under high temperature and high humidity conditions.

In the toner of the present invention, the toner has a particle size 1.02 to 1.10 times larger than that of the base particle. In the present invention, by causing the toner particle to have a particle size not smaller than 1.02 times the particle size of the base particle, it is possible to increase the thickness of the surface layer formed by the organic fine particles and improve the durability and storage stability, and, by controlling the toner particle to have a particle size not larger than 1.10 times the particle size of the base particle, it is possible to prevent a decrease in the offset resistance due to reduction of the oozing effect of the releasing agent.

A manufacturing method of toner of the present invention comprises the steps of mixing cross-linked type organic fine particles having a core-shell structure with a solution containing a neutralizer; dispersing a composition for forming a base particle, which contains a releasing agent and a colorant, into the solution in which the organic fine particles are mixed; and separating the composition from the solution.

In the manufacturing method of toner of the present invention, by neutralizing the organic fine particles with a neutralizer, the organic fine particles swell and dispersion ability appears, and, by using the organic fine particles having the dispersion ability as a dispersing agent, the organic fine particles form a uniform film on the surface of the base particles, and therefore it is possible to manufacture a toner having high low-temperature fixing ability and durability by simple processes.

In the manufacturing method of toner of the present invention, the organic fine particles contain an ionic functional group, and the method further comprises the step of reversely neutralizing the ionic functional group contained in the organic fine particles after dispersing the composition into the solution. In the manufacturing method of toner of the present invention, by reversely neutralizing the ionic functional group contained in the organic fine particles, it is possible to maintain the environmental stability without the necessity of removing the dispersing agent.

In the manufacturing method of toner of the present invention, the composition contains a monomer having an ethylenically unsaturated bond, and the method further comprises the step of polymerizing the monomer by heating after dispersing the composition into the solution. In the manufacturing method of toner of the present invention, by heating the composition containing the monomer having an ethylenically unsaturated bond after dispersing the composition into the solution together with an initiator for starting radical polymerization, it is possible to manufacture a toner by radical polymerization of the monomer. Consequently, it is possible to manufacture a toner which achieves high resolution because of its small particle size and achieves excellent durability because of its spherical shape.

In the manufacturing method of toner of the present invention, the composition contains a binder. In the manufacturing method of toner of the present invention, it is possible to manufacture a toner by an emulsion dispersion method using a composition containing a binder. Consequently, it is possible to manufacture a toner which achieves high resolution because of its small particle size and achieves excellent durability because of its spherical shape. Moreover, since the toner can be manufactured using a resin with high transparency, such as a polyester resin and a polyether resin, it is possible to manufacture a toner suitable for the formation of color images.

In the manufacturing method of toner of the present invention, the composition has a kinematic viscosity of 100 St or less before dispersion. In the manufacturing method of toner of the present invention, it is possible to manufacture a toner with good quality in a stable manner.

The above and further objects and features of the invention will more fully be apparent from the following detailed description with accompanying drawings.

BRIEF DESCRIPTION OF THE SEVERAL VIEWS OF THE DRAWINGS

FIG. 3A and FIG. 3B are tables showing the evaluation results of toner particles.

DETAILED DESCRIPTION OF THE INVENTION

The following description will explain in detail the present invention, based on the drawings illustrating an embodiment thereof.

Figure 1:
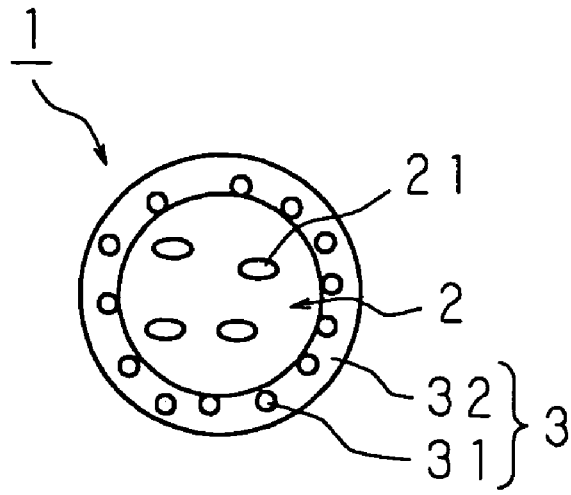
FIG. 1 is a cross sectional view schematically showing a toner of the present invention.
Figure 2:
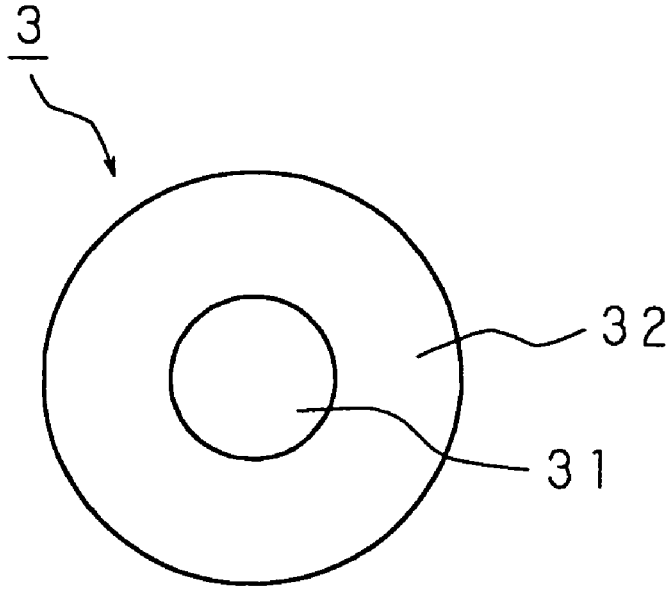
FIG. 2 is a cross sectional view schematically showing an organic fine particle to be attached to the toner of the present invention.

FIG. 1 is a cross sectional view schematically showing a toner of the present invention, and FIG. 2 is a cross sectional view schematically showing an organic fine particle to be attached to the toner of the present invention.

In FIG. 1, numeral 1 represents a toner of the present invention necessary for an electrophotographic technique that is applied to image forming apparatuses such as copying machines and printer machines, and the toner 1 of the present invention has a capsule structure in which a number of organic fine particles 3 having a smaller particle size than a base particle 2 are attached to the base particle 2, and is used for oil-less fixing that realizes excellent low-temperature fixing performance and storage stability. The base particle 2 contains a releasing agent (wax) 21 necessary for oil-less fixing.

As the organic fine particles 3 to be attached to the base particle 2, the toner 1 of the present invention uses organic fine particles 3 having a core-shell structure including a core part 31 and a shell part 32 covering the core part 31. Moreover, the organic fine particles 3 are of cross-linked type, capable of improving the durability and storage stability with a lower amount of addition of the organic fine particles 3 compared to non-cross-linked type organic fine particles, and prevent a decrease in the offset resistance due to reduction of the oozing effect of the releasing agent 21 in oil-less fixing because there is no need to increase the amount of addition of the organic fine particles. In particular, since the cross-linking degree of the core part 31 of the organic fine particles 3 having the core-shell structure is higher than that of the shell part 32, the shell part 32 forms a micro domain and improves the durability, and the shell part 32 with a lower cross-linking degree promotes fusion between the organic fine particles 3 and the base particle 2 and between the organic fine particles 3, thereby maintaining durability during long-time running. Besides, the shell part 32 is softened during fixing and the releasing agent 21 oozes out onto the surface along the shell part 32, and therefore the offset resistance is improved.

As a method of manufacturing organic fine particles having a core-shell structure explained using FIG. 1 and FIG. 2, it is preferable to employ a soap-free emulsion polymerization method using chemicals such as a reactive emulsifier, hydrophilic monomer persulfate-based initiator, ionic or non-ionic water-soluble ethylenically unsaturated monomer to be copolymerized, water-soluble polymer and oligomer, decomposition type emulsifier, and cross-linked type emulsifier. The soap-free emulsion polymerization method to be applied to the manufacture of toner of the present invention is not limited to specific methods, and any method known to a person skilled in the art may be used.

Examples of reactive emulsifiers used in the soap-free emulsion polymerization method applied to the manufacture of organic fine particles necessary for the toner of the present invention include chemicals such as HS-5, HS-10, HS-20, RN-20, RN-30, RN-50, H-3881 and H-3855 (all available from Dai-ichi Kogyo Seiyaku Co., Ltd.), and RA-1022 (available from Nippon Nyukazai Co., Ltd.). Moreover, examples of initiators used in the soap-free emulsion polymerization method include water-soluble chemicals such as 2,2'-azobis (2-amidinopropane) dihydrochloride, 4,4-azobis (4-cyanovaleric acid), 2,2'-azobis [2-(5-methyl-2-imidazoline-2-yl)propane dihydrochloride, 2,2'-azobis [2-(methyl-N-(1,1-bis(hydroxymethyl)-2-hydroxyethyl) propionamide], and 2,2'-azobis [2-(methyl-N-(2-hydroxyethyl) propionamide].

In the manufacture of organic fine particles necessary for the toner of the present invention, the method of forming a two-layer structure of core and shell is not particularly limited, but, the two-layer structure can be realized by, for example, two-step polymerization in which the core part is formed by polymerizing an ethylenically unsaturated monomer and a cross-linked copolymerizable monomer, and the shell part is formed by polymerizing the ethylenically unsaturated monomer, cross-linked copolymerizable monomer and a monomer having an ionic functional group to make the ratio of the cross-linking agent smaller than in the core part.

For the shell part of the organic fine particles necessary for the toner of the present invention, it is preferable to design a resin so that, when the ionic functional group is neutralized, the organic fine particles have a particle size not smaller than 1.2 times, more preferably 1.3 times, and most preferably 1.5 times, the particle size before neutralization. By neutralizing the ionic functional group of the organic fine particles, the organic fine particles swell, thereby promoting fusion between the organic fine particles and the base particle and between the organic fine particles and improving the durability and the offset resistance during long-time running. In particular, this effect is significant when the particle size increases by 1.2 times or more.

The ethylenically unsaturated monomer necessary for forming the core-shell structure of the organic fine particles is not particularly limited, and it is possible to use, for example, compounds such as alkyl esters of acrylic acid or methacrylic acid, such as methyl (meth)acrylate, ethyl (meth)acrylate, n-butyl (meth)acrylate, isobutyl (meth)acrylate, and 2-ehtylhexyl (meth)acrylate. It may be possible to use one kind of these compounds, or two or more kinds of these compounds together.

Besides, the ethylenically unsaturated monomer necessary for forming the core-shell structure of the organic fine particles may be polymerized with other copolymerizable monomers. Examples of other monomers that can be copolymerized with the ethylenically unsaturated monomer include monomers such as styrene, α-methyl styrene, vinyl toluene, t-butyl styrene, ethylene, propylene, vinyl acetate, vinyl propionate, acrylonitrile, and methacrylonitrile. It may be possible to use one kind of these monomers, or two or more kinds of these monomers together.

Examples of cross-linked copolymerizable monomers necessary for forming the core-shell structure of the organic fine particles include cross-linked copolymerizable monomers such as a monomer having two or more radically polymerizable ethylenically unsaturated bonds in a molecule, and two or more kinds of ethylenically unsaturated monomers having functional groups that can react with each other.

Examples of monomers having two or more radically polymerizable ethylenically unsaturated bonds in a molecule include monomers such as polymerizable unsaturated monocarboxylic acid esters of polyhydric alcohols, polymerizable unsaturated alcohol esters of polybasic acids, and aromatic compounds substituted with two or more vinyl groups. More specifically, examples of monomers include ethylene glycol diacrylate, ethylene glycol dimethacrylate, triethylene glycol dimethacrylate, tetraethylene glycol dimethacrylate, 1,3-butylene glycol dimethacrylate, trimethylol propane triacrylate, trimethylol propane trimethacrylate, 1,4-butanediol diacrylate, neopentyl glycol diacrylate, 1,6-hexanediol diacrylate, pentaerythritol diacrylate, pentaerythritol dimethacrylate, pentaerythritol trimethacrylate, pentaerythritol tetramethacrylate, glycerol dimethacrylate, glycerol diacrylate, glycerol allyloxy dimethacrylate, 1,1,1-trishydroxymethyl ethane diacrylate, 1,1,1-trishydroxymethyl ethane triacrylate, 1,1,1-trishydroxymethyl ethane dimethacrylate, 1,1,1-trishydroxymethyl ethane trimethacrylate, 1,1,1-trishydroxymethyl propane diacrylate, 1,1,1-trishydroxymethyl propane dimethacrylate, 1,1,1-trishydroxymethyl propane trimethacrylate, triallyl cyanurate, triallyl isocyanurate, triallyl trimellitate, diallyl terephthalate, diallyl phthalate, and divinyl benzene. It may be possible to use one kind of these monomers, or two or more kinds of these monomers together.

For the formation of the shell part of organic fine particles necessary for the toner of the present invention, copolymerizable monomers such as the above-mentioned monomers having ethylenically unsaturated bonds, and monomers such as cross-linked type polymerizable unsaturated monomers and polymerizable unsaturated monomers containing an ionic functional group are mixed. Examples of polymerizable unsaturated monomers containing an ionic functional group include monomers containing a carboxyl group such as acrylic acid, methacrylic acid, crotonic acid, itaconic acid, maleic acid, and fumaric acid; monomers containing an amino group such as dimethyl aminoethyl acrylate, dimethyl aminoethyl methacrylate, dimethyl aminopropyl acrylate, dimethyl aminopropyl methacrylate, and alkyl(meth)acrylate such as dimethyl aminopropyl(meth)acryl amide; monomers containing a sulfonic acid group such as vinyl sulfonic acid; and monomers containing a phosphoric acid group such as mono[2-(meth)acryloyloxyethyl]acid phosphate, and 3-chloro-2-acid phosphooxypropyl (meth)acrylate.

In the toner of the present invention, it is preferable to attach the organic fine particles to the surface of the base particle so as to make the particle size 1.02 to 1.10 times larger, and more preferably 1.04 to 1.08 times larger. In other words, it is preferable to satisfy $1.10 \geqq Rg/Ra \geqq 1.02$, and more preferably $1.08 \geqq Rg/Ra \geqq 1.04$, where Ra is the particle size of the base particle to which the organic fine particles are not attached, and Rg is the particle size with the organic fine particles attached to the surface of the base particle. It is possible to thicken the surface layer formed by the organic fine particles and improve the durability and storage stability by satisfying $Rg/Ra \geqq 1.02$, and it is possible to prevent a decrease in the offset resistance due to reduction of the oozing effect of the releasing agent by satisfying $Rg/Ra \leqq 1.10$.

Next, a manufacturing method of toner of the present invention will be explained. In the manufacturing method of toner of the present invention, as a first step, cross-linked type organic fine particles having a core-shell structure are mixed with an aqueous solution containing a neutralizer. By neutralizing the organic fine particles with the neutralizer in such a manner, the particle size of the organic fine particles swells to 1.2 times or more, and dispersion ability appears. By using the organic fine particles having the dispersion ability as a dispersing agent, it is possible to uniformly disperse the organic fine particles on the surface layer of the base particle and form a uniform film, thereby enabling manufacture of a toner having excellent low-temperature fixing ability and durability.

As the neutralizer, it is possible to use compounds capable of forming an ion pair with a functional group such as a carboxyl group, phosphoric group, and sulfonic group, and specific examples of the neutralizer include compounds containing nitrogen such as tertiary amines such as triethyl amine, tri-n-butyl amine, triallyl amine, tri-n-pentyl amine, trihexyl amine, tri-benzyl amine, triphenyl amine, dimetyl-n-lauryl amine, dimethyl-n-palmityl amine, dimethyl-n-stearyl amine, dimethyl-benzyl amine, and dimethyl aniline; secondary amines such as diethyl amine, di-n-butyl amine, diallyl amine, di-n-pentyl amine, dihexyl amine, dibenzyl amine and diphenyl amine; and primary amines such as t-butyl amine, iso-butyl amine, n-butyl amine, 2-aminobenzotrifluoride, m-aminoacetophenone, and 4-aminoacetanilide.

The neutralizer may also be compounds of alkyl esters of acrylic acid or methacrylic acid such as methyl (meth) acrylate, ethyl (meth)acrylate, n-butyl (meth)acrylate, isobutyl (meth)acrylate, and 2-ethylhexyl (meth)acrylate. Further, when the surface of the organic fine particles is a functional group such as an amino group, an ammonium group, a sulfonium group, and a phosphonium group, it is possible to use acidic compounds that form ionic bonds with these functional groups, and, more specifically, it is possible to use, for example, acidic compounds such as hydrochloric acid, sulfuric acid, and acetic acid. Note that it may be possible to use one kind of these compounds, or two or more kinds of these compounds together. A suitable amount of the neutralizer is added according to the swelling degree of the organic fine particles.

Further, in the manufacturing method of toner of the present invention, as a second step, a composition (hereinafter referred to as the composition A) for forming the base particle, which contains a releasing agent and a colorant, is mixed in the aqueous solution in which the organic fine particles are mixed. At this time, by controlling the kinematic viscosity of the composition A to be 100 St or less, i.e., to be Z5 or less when measured by the Gardner viscometer, it is possible to facilitate dispersion into the aqueous solution and prevent an increase in the particle size.

As a method of controlling the composition A to have a viscosity of Z5 or less, there are a method in which chemicals such as an organic solvent and the above-mentioned monomers having ethylenically unsaturated bonds are added; and a heating method. In the case of adding an organic solvent, it is possible to add as the solvent, for example, organic solvents such as ketones such as methyl ethyl ketone and methyl isobutyl ketone; acetic esters such as ethyl acetate and butyl acetate; nitrogen-containing heterocyclic compounds such as n-methyl-2-pirolidon, pyridine and pyrrole; aliphatic hydrocarbons such as hexane and cyclohexane; amides such as N-methyl formamide and N,N-dimethyl formamide; ethers such as diethyl ether; and sulfur-containing compounds such as dimethyl sulfoxide. It may be possible to use one kind of these solvents, or two or more kinds of these solvents together, and it is particularly preferable to use organic solvents, such as methyl ethyl ketone, toluene and xylem, which have high resin dissolution properties and allow easy removal of the solvent.

As colorants necessary for the toner of the present invention, it is possible to use pigments of various kinds and various colors irrespective of organic or inorganic. Specifically, examples of colorants used as black pigments include carbon black, copper oxide, manganese dioxide, aniline black, activated carbon, non-magnetic ferrite, magnetic ferrite, and magnetite.

Examples of yellow pigments include colorants such as chrome yellow, zinc yellow, cadmium yellow, yellow iron oxide, Mineral Fast Yellow, nickel titanium yellow, Navel Yellow, Naphthol Yellow S, Hansa Yellow G, Hansa Yellow 10G, Benzidine Yellow G, Benzidine Yellow GR, Quinoline Yellow Lake, Permanent Yellow NCG, and Tartrazine Lake.

Examples of orange pigments include colorants such as red chrome yellow, molybdenum orange, Permanent Orange GTR, Pyrazolone Orange, Vulcan Orange, Indanthrene Brilliant Orange RK, Benzidine Orange G. and Indanthrene Brilliant Orange GK.

Examples of red pigments include colorants such as red iron oxide, cadmium red, red lead, mercury sulfide, cadmium, Permanent Red 4R, Lithol Red, Pyrazolone Red, Watchung Red, calcium salt, Lake Red C, Lake Red D, Brilliant Carmine 6B, eosine lake, Rhodamine Lake B, Alizarin Lake, and Brilliant Carmine 3B.

Examples of violet pigments include colorants such as manganese violet, Fast Violet B, and Methyl Violet Lake.

Examples of blue pigments include colorants such as Prussian blue, cobalt blue, alkali blue lake, Victoria Blue Lake, Phthalocyanine Blue, non-metal Phtalocyanine Blue, a partially chlorinated pigment of Phthalocyanine Blue, Fast Sky Blue, and Indanthrene Blue BC.

Examples of green pigments include colorants such as chrome green, chromium oxide, Pigment Green B, Malachite Green Lake, and Final Yellow Green G.

Moreover, by using a colorant treated by a flushing method such as Microlith (available from Ciba Specialty Chemicals), it is possible to manufacture a toner having high colorant dispersion properties and suitable for color images.

For example, in the case where a binding resin is mixed in the toner, if the content of the colorant is more than 20 parts by weight per 100 parts by weight of the binding resin, the transparency is decreased, and particularly the transparency and color reproduction performance of green, red and blue which are combination colors are decreased, and the reproduction performance of the skin color of human tends to be decreased. If the content of the colorant is less than 5 parts by weight, the tinting strength is decreased, and it becomes difficult to obtain high quality images with high image density, and the cost required for image formation increases because it is necessary to increase the deposit. Thus, the content of the colorant is preferably 4 to 20 parts by weight, and more preferably 8 to 14 parts by weight per 100 parts by weight of the binding resin of the toner.

In addition to the above-mentioned colorants, it is possible to mix components, such as a binding resin, magnetic powder, offset preventing agent, and charge control agent, if necessary, in the toner of the present invention. The binding resin is not particularly limited if it is a thermoplastic resin. More specifically, examples of the binding resin include compounds such as styrenes such as styrene, para-chlorostyrene, and α-methyl styrene; acryl-based monomers such as methyl acrylate, ethyl acrylate, n-propyl acrylate, lauryl acrylate, and 2-ethylhexyl acrylate; methacryl-based monomers such as methyl methacrylate, ethyl methacrylate, n-propyl methacrylate, lauryl methacrylate, and 2-ethylhexyl methacrylate; ethylenically unsaturated monomers such as acrylic acid, methacrylic acid, and sodium styrene sulfonate; vinyl nitriles such as acrylonitrile and methacrylonitrile; vinyl ethers such as vinyl methyl ether and vinyl isobutyl ether; and vinyl ketones such as vinyl methyl ketone, vinyl ethyl ketone, and vinyl isopropenyl ketone. Further, examples of the binding resin include compounds such as homopolymers of monomers of olefins such as ethylene, propylene, and butadiene; copolymers obtained by combining two or more kinds of these monomers; mixtures of these homopolymers and/or copolymers; non-vinyl condensed resins such as epoxy resin, polyester resin, polyurethane resin, polyamide resin, cellulose resin, and polyether resin; mixtures of these resins and vinyl-based resins; and graft polymers obtained by polymerizing vinyl-based monomers in the presence of these resins. Note that among the above-mentioned variety of resins, polyester resin and polyether resin are superior in transparency and durability.

Examples of the magnetic powder include magnetic materials such as magnetite, γ-hematite, and various ferrites.

As the releasing agent used to improve the fixing ability of the toner of the present invention, it is possible to use, for example, various releasing agents, and more particularly polyolefin-based waxes such as low-molecular-weight polypropylene and polyethylene, and oxidized polypropylene- and polyethylene. Note that the amount of addition of the releasing agent is preferably 1 to 10 parts by weight per 100 parts by weight of the binding resin.

As the charge control agent, there are two types: one for negatively charged toner and the other for positively charged toner.

Examples of charge control agents for negatively charged toner include surface active agents such as chromium azo complex dye, iron azo complex dye, cobalt azo complex dye, chromium complex, zinc complex, aluminum complex and boron complex of salicylic acid and salicylic acid derivatives, salicylate compound, chromium, zinc, aluminum and boron complexes of naphthol acid and naphthol acid derivatives, naphtholate compound, chromium, zinc, aluminum, and boron complexes of benzilic acid and benzilic acid derivatives, benzilate compound, long-chain alkyl carbonate, and long-chain alkyl sulfonate. Examples of charge control agents for positively charged toner include nigrosine dye, nigrosine dye derivatives, triphenyl methane derivatives, and derivatives of quaternary ammonium salts, quaternary phosphonium salts, quaternary pyridinium salts, guanidine salts, and amidine salts. Note that the amount of addition of the charge control agent is preferably 0.01 to 5 parts by weight per 100 parts by weight of the binding resin.

For the toner of the present invention, when dispersing the binding resin, magnetic powder, offset preventing agent, and charge control agent into the toner, a dispersing agent may be used. Examples of dispersing agents include commercially available products such as BYK-182, BYK-161, BYK-162, BYK-163, BYK-164, BYK-116, BYK-111, BYK-2000, and BYK-2001 (available from BYK Chemie); Solsperse-20000 and Solsperse-38500 (available from AVECIA Ltd.); EFKA-4046, EFKA-4047, EFKA-2000, EFKA-2002, EFKA-4009, and EFKA-4010 (available from EFKA Chemicals); and Surfynol GA (available from Air Products). It may be possible to use one kind of these dispersing agents, or mixtures of two or more kinds of these dispersing agents.

Note that, if the amount of the dispersing agent for the colorant is more than 100 parts by weight per 100 parts by weight of the colorant, the dispersing agent adversely affects the charging stability and fixing ability under a high temperature environment, and therefore the dispersing agent is preferably 100 parts or less by weight, and more preferably 50 parts or less by weight per 100 parts by weight of the colorant.

In the manufacturing method of toner of the present invention, as a third step, mechanical shear is applied using a dispersion machine with rotary blades to the aqueous solution in which the organic fine particles and composition A are mixed so as to uniformly disperse the composition A in the aqueous solution. As the dispersion machine with rotary blades for use in the manufacturing method of toner of the present invention, it is possible to use, for example, commercially available emulsification machines or dispersion machines such as batch type emulsification machines such as Ultratarax (available from IKA), Polytoron (available from KINEMATICA), TK Auto Homo Mixer (available from Tokushu Kikai Kogyo Co., Ltd.), and National Cooking Mixer (available from Matsushita Electric Industrial Co., Ltd.); continuous type emulsification machines such as Ebara Milder (available from Ebara Corporation), TK Pipe Line Homo-Mixer, TK Homomic Line Flow (available from Tokushu Kikai Kogyo Co., Ltd.), Colloid Mill (available from Shinko Pantec Co., Ltd.), slasher, trigonal wet grinder (available from Mitsui Miike Kakoki), Cavitoron (available from Eurotec Ltd.), and Fine Flow Mill (available from Pacific Machinery and Engineering Co., Ltd.); and batch and continuous emulsification machines such as Clearmix (available from Mtechnique), and Filmics (available from Tokushu Kikai Kogyo Co., Ltd.).

In the manufacturing method of toner of the present invention, as a fourth step, after dispersing the composition A uniformly in the aqueous solution, the ionic functional group contained in the organic fine particles attached to the composition A and neutralized in the first step is reversely neutralized. By reversely neutralizing the ionic functional group, it is possible to maintain the environmental stability without the necessity of removing the dispersing agent, and it is possible to manufacture a capsule type toner that has excellent industrial productivity and does not require external addition of organic fine particles. Examples of the reverse neutralizer include solutions such as aqueous ammonia and aqueous hydrochloric acid solution.

In the manufacturing method of toner of the present invention, as a fifth step, the dispersed composition A to which the organic fine particles are attached is removed from the aqueous solution.

In the manufacturing method of toner of the present invention, as a sixth step, the composition A removed from the aqueous solution is dried and sifted, and then various additives are added to the composition A, if necessary, to obtain a toner of the present invention. The drying method, sifting method and addition method in the sixth step are not limited to specific methods.

For instance, as additives added for the purpose of adjusting fluidity, preventing toner filming on the photosensitive member and improving the cleaning performance of toner remaining on the photosensitive drum, it is possible to use, for example, chemicals such as inorganic oxides such as silica, alumina, titania, zirconia, tin oxide and zinc oxide, mono and copolymer resin particles of compounds such as acrylic acid esters, methacrylic acid esters and styrene, fluororesin particles, silicone resin particles, higher fatty acids such as stearic acid and metallic salts of the higher fatty acids, carbon black, graphite fluoride, silicon carbide, and boron nitride. The amount of addition of these additives is preferably 0.2 to 10 parts by weight per 100 parts by weight of the binding resin.

Note that in the manufacturing method of toner of the present invention, in the case where the composition A containing a monomer having an ethylenically unsaturated bond is used, after dispersing the composition A in the aqueous solution together with an initiator for starting radical polymerization in the above-mentioned third step, the aqueous solution in which the composition A is dispersed is transferred to a reaction can, heated to a predetermined temperature under nitrogen air flow and agitated for a predetermined time, so that the monomer is polymerized by radical polymerization. By proceeding radical polymerization in such a manner, it is possible to manufacture a spherical toner with small particle size. Since the toner manufactured in this manner has a small particle size, it is possible to form images with high resolution, and, since the toner has a spherical shape, it is possible to achieve excellent durability.

In the manufacturing method of toner of the present invention, as the initiator for initiating radical polymerization, it is possible to use, for example, water-insoluble initiators such as lauryl peroxide and benzyl peroxide.

Besides, in the manufacturing method of toner of the present invention, if the composition A contains an organic solvent, the process of removing the organic solvent contained in the dispersed suspension from the system by vacuum distillation or other method is performed after the above-mentioned third step. By removing the organic solvent by a method such as vacuum distillation, it is possible to manufacture a spherical toner with small particle size. Since the toner manufactured in this manner has a small particle size, it is possible to form images with high resolution, and, since the toner has a spherical shape, it is possible to achieve excellent durability. Moreover, it is also possible to manufacture the toner by using resins with high transparency such as a polyester resin and a polyether resin, and the toner manufactured by using a resin with high transparency has properties suitable for the formation of color images.

The toner of the present invention manufactured by the above-mentioned method is used to form an image on a sheet, such as copy paper, in an image forming apparatus such as a copying machine and a printer machine. In the image forming apparatus using the toner of the present invention, when forming an image on a sheet, the photosensitive drum is uniformly charged, an electrostatic latent image is formed on the charged photosensitive drum by scanning an optical image based on the image to be formed, development is performed to turn the formed electrostatic latent image into a visible image by attaching the toner of the invention to the electrostatic latent image, the resultant visible image is transferred to the sheet, and the transferred toner is fixed to the sheet to form the image.

Embodiment

Next, the following description will explain the production conditions and evaluations of a toner of the present invention and comparative sample toners manufactured by changing various conditions. First, the method of producing organic fine particles necessary for a toner is explained. Not that the swelling rate of the produced organic fine particles is calculated. The swelling rate is calculated by equation 1 shown below by measuring the volume average particle size La before formation of the shell part and the volume average particle size Lb at a stage where the organic fine particles have been swelled by mixing a neutralizer after forming the shell part, with the use of DLS-700 (available from Otsuka Electronics Co., Ltd.).

$$\text{Swelling rate} = Lb/La \qquad \text{Equation 1}$$

where La: volume average particle size before formation of the shell part, and Lb: volume average particle size after neutralization.

(Organic Fine Particles MG-1)

2 parts by weight of RA-1022 (anionic reactive emulsifier available from Nippon Nyukazai Co., Ltd.) and 168 parts by weight of deionized water are placed into a reaction container having an agitation and heating device, a thermometer, a nitrogen introduction pipe and a cooling pipe, and heated to 80 degree centigrade. A monomer mixture (pre-emulsion) composed of 2 parts by weight of RA-1022 (anionic reactive emulsifier available from Nippon Nyukazai Co., Ltd.), 252 parts by weight of deionized water, 50 parts by weight of styrene, 20 parts by weight of n-butyl acrylate and 6.0 parts by weight of ethylene glycol dimethacrylate, and 56 parts by weight of an aqueous initiator solution composed of 0.5 part by weight of ammonium peroxo disulfate and 62 parts by weight of deionized water are simultaneously dropped into the reaction container over 110 minutes, and agitated for further 60 minutes. Next, 20 parts by weight of a monomer mixture composed of 9.5 parts by weight of acrylic acid, 5.0 parts by weight of styrene, 5.0 parts by weight of n-butyl acrylate and 0.5 part by weight of ethylene glycol dimethacrylate, and 6.5 parts by weight of the remaining aqueous initiator solution are dropped over 10 minutes and agitated for further 3 hours, and then the reaction is completed to produce organic fine particles MG-1.

The organic fine particles MG-1 produced under such conditions have a volume average particle size of 102 nm before formation of the shell part, and the volume average particle size swells to 158 nm by adding a predetermined amount of 1N aqueous ammonia for neutralization. In other words, the fine particle swelling rate of the organic fine particles MG-1 is 158/102=1.55.

(Organic Fine Particles MG-2)

In the manufacturing method of organic fine particles MG-1, by increasing the amounts of the reactive emulsifier and deionized water, organic fine particles MG-2 having a volume average particle size of 38 nm before formation of the shell part and a volume average particle size of 49 nm after neutralization are produced. The fine particle swelling rate of the organic fine particles MG-2 is 49/38=1.29.

(Organic Fine Particles MG-3)

In the manufacturing method of organic fine particles MG-1, by increasing the amounts of the reactive emulsifier and deionized water, organic fine particles MG-3 having a volume average particle size of 25 nm before formation of the shell part and a volume average particle size of 38 nm after neutralization are produced. The fine particle swelling rate of the organic fine particles MG-3 is 38/25=1.52.

(Organic Fine Particles MG-4)

In the manufacturing method of organic fine particles MG-1, by replacing 9.5 parts by weight of acrylic acid with methyl acrylate, organic fine particles MG-4 having a volume average particle size of 95 nm before formation of the shell part and a volume average particle size of 146 nm after neutralization are produced. The fine particle swelling rate of the organic fine particles MG-4 is 146/95=1.54.

(Organic Fine Particles MG-5)

In the manufacturing method of organic fine particles MG-1, by replacing 6.0 parts by weight and 0.5 part by weight of ethylene glycol dimethacrylate with methyl acrylate, organic fine particles MG-5 having a volume average particle size of 98 nm before formation of the shell part and a volume average particle size of 193 nm after neutralization are produced. The fine particle swelling rate of the organic fine particles MG-5 is 193/98=1.97.

(Organic Fine Particles MG-6)

In the manufacturing method of organic fine particles MG-i, by replacing 2 parts by weight of RA-1022 (anionic reactive emulsifier) with sodium dodecyl sulfonate, organic fine particles MG-6 having a volume average particle size of 120 nm before formation of the shell part and a volume average particle size of 180 nm after neutralization are produced. The fine particle swelling rate of the organic fine particles MG-6 is 180/120=1.50.

(Organic Fine Particles MG-7)

After placing 300 ml of deionized water into a separable flask having an agitator, a thermometer and a nitrogen introduction pipe and performing nitrogen substitution, the deionized water is heated to 75 degree centigrade. 5 parts by weight of methyl methacrylate and 1 part by weight of sodium sulfite (available from Wako Pure Chemical Industries, Ltd.) are added to the deionized water and agitated for 10 minutes. Then, a monomer mixture composed of 45 parts by weight of styrene, 27 parts by weight of n-butyl acrylate and 8.0 parts by weight of ethylene glycol dimethacrylate is dropped over 2 hours, and agitated for further 60 minutes. Moreover, 15 parts by weight of a monomer mixture composed of 5.8 parts by weight of acrylic acid, 5.0 parts by weight of styrene, 4.0 parts by weight of n-butyl acrylate and 0.2 part by weight of ethylene glycol dimethacrylate is dropped over 10 minutes and agitated for further 3 hours, and then the reaction is completed to produce organic fine particles MG-7.

The organic fine particles MG-7 produced under such conditions have a volume average particle size of 270 nm before formation of the shell part, and the volume average particle size swells to 337 nm by adding a predetermined amount of 1N aqueous ammonia for neutralization. In other words, the fine particle swelling rate of the organic fine particles MG-7 is 337/270=1.25.

(Organic Fine Particles MG-8)

In the manufacturing method of organic fine particles MG-7, by changing the amounts of sodium sulfite and deionized water, organic fine particles MG-8 having a volume average particle size of 350 nm before formation of the shell part and a volume average particle size of 483 nm after neutralization are produced. The fine particle swelling rate of the organic fine particles MG-8 is 483/350=1.38.

(Organic Fine Particles MG-9)

By dropping the monomer mixtures, which are dropped in two steps in the manufacturing method of organic fine particles MG-7, at one time, organic fine particles MG-9 having a volume average particle size of 255 nm before formation of the shell part and a volume average particle size of 260 nm after neutralization are produced. The fine particle swelling rate of the organic fine particles MG-9 is 260/255=1.02. In MG-9, by dropping the monomer mixtures at one time instead of two steps, a single cross-linked structure is formed without forming a cross-linked structure of the core-shell structure.

Next, the following description will explain a method of producing a composition for forming a base particle necessary for a toner. The composition is produced by adding glass beads to a mixture prepared by mixing predetermined amounts of monomers, resin solution, colorant, dispersing agent, charge control agent and releasing agent under the following conditions, and dispersing the composition at room temperature for three hours using a dispersion machine.

(Composition P-1)

Styrene: 500 parts by weight
N-butyl acrylate: 238 parts by weight
Divinyl benzene: 2 parts by weight
Phthalocyanine Blue: 120 parts by weight
BYK-164 (pigment dispersing agent available from BYK Chemie): 40 parts by weight
Charge regulator: 25 parts by weight
Polypropylene wax: 75 parts by weight
Lauryl peroxide: 20 parts by weight (Composition P-2)

SE-105 (polyester resin available from Dainippon Ink and Chemicals, Inc.): 780 parts by weight
Toluene: 1500 parts by weight
Phthalocyanine Blue: 120 parts by weight
Charge regulator: 25 parts by weight
Polypropylene wax: 75 parts by weight Next, the method of producing a toner using organic fine particles and a composition is explained. The volume average particle size of the produced toner particles and the coefficient of variation are measured by the Coulter Multisizer II (available from Coulter) using a 100 μm aperture as an aperture. Besides, the thickness of the capsule layer on the toner surface is calculated by equation 2 shown below by measuring the volume average particle size Ra of the base particles and the volume average particle size Rg of toner particles formed by attachment of the organic fine particles to the surface of the base particles.

$$\text{Capsule layer thickness} = Rg/Ra \qquad \text{Equation 2}$$

where Ra: volume average particle size of base particles, and Rg: volume average particle size of toner particles.

(Toner T-1)

450 parts by weight of the composition P-1 is added to 1000 parts by weight of an aqueous solution containing 50 parts by weight of the organic fine particles MG-1 measured in terms of solid dispersion and a predetermined amount of 1N aqueous ammonia, and dispersion is performed until a predetermined particle size is obtained while measuring the particle size by Polytoron (available from KINEMATICA). After the dispersion liquid obtained by the dispersion process is placed into a separable flask having an agitator, a thermometer, a nitrogen introduction pipe and a cooling pipe and nitrogen substitution is performed, the dispersion liquid is agitated at 78 degree centigrade for 5 hours to perform a polymerization reaction. After reversely neutralizing the resultant dispersion liquid by adding a 1N aqueous hydrochloric solution, the dispersion liquid is heated under reduced pressure to attach the organic fine particles to the composition surface and remove unreacted monomers.

After repeatedly cleaning the resultant solution by adding deionized water and performing condensation, the solution is dried in a freeze dryer to obtain a powder. 100 parts by weight of the obtained powder and 1.0 part by weight of hydrophobic silica powder (BET specific surface area of 120 $m^2/g$) which was surface treated with a silane coupling agent and dimethyl silicone oil are mixed to produce a toner T-1 with negative frictional electrification properties. The volume average particle size of the toner T-1 is 5.5 μm, and the thickness Rg/Ra of the capsule layer indicated by the ratio of the volume average particle size of the base particle and the volume average particle size Rg when the organic fine particles are attached to the surface of the base particle is 1.03.

(Toner T-2)

In the manufacturing method of toner T-1, by changing the mixed amount of the organic fine particles MG-1 to 70 parts by weight, a toner T-2 with a volume average particle size of 5.6 μm and a capsule layer thickness Rg/Ra of 1.05 is produced.

(Toner T-3)

In the manufacturing method of toner T-1, by changing the mixed amount of the organic fine particles MG-1 to 115 parts by weight, a toner T-3 with a volume average particle size of 5.3 μm and a capsule layer thickness Rg/Ra of 1.09 is produced.

(Toner T-4)

In the manufacturing method of toner T-1, by changing the mixed amount of the organic fine particles MG-1 to 160 parts by weight, a toner T-4 with a volume average particle size of 5.5 μm and a capsule layer thickness Rg/Ra of 1.12 is produced.

(Toner T-5)

1075 parts by weight of the composition P-1 is added to 1000 parts by weight of an aqueous solution containing 70 parts by weight of the organic fine particles MG-2 measured in terms of solid dispersion and a predetermined amount of 1N aqueous ammonia, and dispersion is performed until a predetermined particle size is obtained while measuring the particle size by Polytoron (available from KINEMATICA). After reversely neutralizing the dispersion liquid obtained by the dispersion process by adding a 1N aqueous hydrochloric solution, the dispersion liquid is heated under reduced pressure to attach the organic fine particles to the composition surface and remove the organic solvent. Then, after repeatedly cleaning the resultant solution by adding deionized water and performing condensation, the solution is dried in a freeze dryer to obtain a powder. 100 parts by weight of the obtained powder and 1.0 part by weight of hydrophobic silica powder (BET specific surface area of 120 $m^2/g$) which was surface treated with a silane coupling agent and dimethyl silicone oil are mixed to produce a toner T-5. The volume average particle size of the toner T-5 is 5.8 μm, and the thickness Rg/Ra of the capsule layer is 1.04.

(Toner T-6)

In the manufacturing method of toner T-2, by using the organic fine particles MG-3 in place of the organic fine particles MG-1, a toner T-6 with a volume average particle size of 5.2 μm and a capsule layer thickness Rg/Ra of 1.03 is produced.

(Toner T-7)

In the manufacturing method of toner T-2, by using the organic fine particles MG-4 in place of the organic fine particles MG-1, a toner T-7 with a volume average particle size of 5.5 μm and a capsule layer thickness Rg/Ra of 1.05 is produced.

(Toner T-8)

In the manufacturing method of toner T-2, by using the organic fine particles MG-5 in place of the organic fine particles MG-1, a toner T-8 with a volume average particle size of 5.7 μm and a capsule layer thickness Rg/Ra of 1.05 is produced.

(Toner T-9)

In the manufacturing method of toner T-2, by using the organic fine particles MG-6 in place of the organic fine particles MG-1, a toner T-9 with a volume average particle size of 5.9 μm and a capsule layer thickness Rg/Ra of 1.04 is produced.

(Toner T-10)

In the manufacturing method of toner T-2, by using the organic fine particles MG-7 in place of the organic fine particles MG-1, a toner T-10 with a volume average particle size of 6.4 μm and a capsule layer thickness Rg/Ra of 1.06 is produced.

(Toner T-1

In the manufacturing method of toner T-2, by using the organic fine particles MG-8 in place of the organic fine particles MG-1, a toner T-11 with a volume average particle size of 6.0 μm and a capsule layer thickness Rg/Ra of 1.04 is produced.

(Toner T-12)

In the manufacturing method of toner T-2, by using the organic fine particles MG-9 in place of the organic fine particles MG-1, a toner T-12 with a volume average particle size of 10.8 μm and a capsule layer thickness Rg/Ra of 1.03 is produced.

(Toner T-13)

In the manufacturing method of toner T-2, by using 10 parts by weight of polyvinyl alcohol (GH-17 available from Nippon Synthetic Chemical Industry, Co., Ltd.) in place of the organic fine particles MG-1, a toner T-13 with a volume average particle size of 5.6 μm and a capsule layer thickness Rg/Ra of 1.00 is produced. When the polyvinyl alcohol is used, a capsule layer is not formed because the polyvinyl alcohol does not attach to the base particle, and therefore Rg/Ra is 1.00.

Further, image formation is performed by an image forming apparatus using the produced toners T-1 to T-13, and the following evaluations are carried out. For image samples to be evaluated in each evaluation, unfixed images are created using a machine ARC-150 with a process speed of 88 mm/sec available from Sharp Corporation, and then fixed at a predetermined temperature by an oil-less fixing type external fixing machine. 75 g/m$^2$ paper is used as test paper, and 52 g/m$^2$ paper is used for offset evaluation.

(Evaluation 1: Fixing Ability Evaluation by Offset Property Measurement)

Unfixed images created according to a predetermined chart are fixed using the external fixing machine while changing the temperature, and the presence or absence of offset on the paper surface on and after the second turn of the fixing roller is evaluated by visual observation. Samples without offset at 130 to 190 degree centigrade and samples without offset at 120 to 200 degree centigrade which are levels at which problems will not occur in actual use are evaluated as "○" and "◎", respectively, and other samples that may cause a problem in actual use are evaluated as "x".

(Evaluation 2: Toner Durability Evaluation by Measurement of Fog on White Base)

Image formation is performed on 10000 pieces of A4-size white paper under an environment of an air temperature of 20 degree and a relative humidity of 50%, and samples without a problem in actual use are evaluated as "◎" or "○" and samples that may cause a problem in actual use are evaluated as "x" by evaluating the white paper by visual observation after printing 10000 pieces of paper.

(Evaluation 3: Charging Stability Evaluation by Environmental Charge Measurement)

Ferrite particles (60 μm, produced by Powder Tech) and a toner are mixed in a ratio of 95:5 and agitated by a ball mill for 30 minutes under an environment of 30 degree centigrade and a relative humidity of 80% (environmental condition HH), and under an environment of 10 degree centigrade and a relative humidity of 20% (environment condition LL), and then the charge amount is measured. The value of charge amount in environmental condition HH/charge amount in environmental condition LL is calculated in percentage. The samples are evaluated and graded in three levels so that samples with a value of not less than 80% are evaluated as "◎", samples with a value of not less than 70% are evaluated as "○", and samples with a value less than 70% are evaluated as "x". "◎" and "○" are evaluated as levels at which there is no problem in actual use.

(Evaluation 4: Transparency Evaluation)

Images are formed on sheets to be used exclusively for an overhead projector (CX-7A4C available from Sharp Corporation) by adjusting the amount of magenta toner to be attached so that the image density is 1.7. The images formed on the sheets to be used exclusively for the overhead projector are used as samples, and transparency is evaluated by measuring the diffuse-transmitted light amount and the total-transmitted light amount with the HGM-2DP for direct read haze computer C light source (available from Suga Test Instruments) and calculating the haze value. As shown in equation 3 below, the haze value is an index indicating the degree of diffusion of light rays transmitted through a transparent sample when parallel light rays are incident on the transparent sample, wherein the light amount of diffused light rays among the light rays transmitted through the sample is represented as the diffuse-transmitted light amount Td, and the total light amount of diffused light rays and parallel light rays transmitted through the sample is represented as the total-transmitted light amount Tt. The smaller the haze value, the smaller the diffuse-transmitted light amount and the higher the transparency.

$$\text{Haze value } (\%) = (Td/Tt) \times 100 \qquad \text{Equation 3}$$

where Td: diffuse-transmitted light amount, and

Tt: total-transmitted light amount.

The samples are evaluated and graded in three levels so that samples with a haze value of 20 or less are evaluated as "◎" samples with a haze value of 25 or less are evaluated as "○", and samples with a haze value of higher than 25 are evaluated as "x". "◎" and "○" are evaluated as levels at which there is no problem in actual use.

FIG. 3 shows the results of evaluation of the respective toner particles graded in three levels, "◎", "○" and "x", by the evaluation methods of Evaluation 1 through Evaluation 4.

As shown in FIG. 3, by manufacturing the toners T-1 to T-7 and T-9 to T-11 of the present invention by attaching cross-linked type organic fine particles having a core-shell structure to the base particle, it is possible to obtain toner with excellent fixing ability, durability, charging stability and transparency. In particular, by using organic fine particles whose particle size before neutralization is 30 to 300 nm, it is possible to obtain toner with excellent durability, fixing ability and transparency. Moreover, by controlling the value of Rg/Ra to fall between 1.02 and 1.10, it is possible to obtain toner with excellent durability. On the other hand, the toner T-8 which has a core-shell structure but is not of cross-linked has the problem of low durability, and the toner T-12 which is of cross-linked type but has a single structure suffers from the problem of low fixing ability and durability.

The manufacturing conditions such as the raw materials and operation steps described in the above-described embodiment show examples of a part of countless embodiments that realize the present invention, and the present invention is not limited to these examples.

As described in detail above, in the toner and the manufacturing method of toner of the present invention, by using cross-linked type organic fine particles as organic fine particles having a core-shell structure to be attached to the base particle, it is possible not only to provide excellent low-temperature fixing ability, but also to improve the durability and storage stability even with a small amount of addition of the organic fine particles compared to non-cross-linked type organic fine particles, and it is also possible to prevent a decrease in the offset resistance due to reduction of the oozing effect of the releasing agent in oil-less fixing because there is no need to increase the amount of addition of the fine particles.

Further, in the present invention, by increasing the cross-linking degree of the core part of organic fine particles having a core-shell structure, the shell structure can form a micro domain and improve the durability. Besides, since the cross-linking degree of the shell part is low, it is possible to promote fusion between the organic fine particles and the base particle and between the organic fine particles, thereby maintaining the durability during long-time running. In addition, the shell part is softened during fixing and the releasing agent oozes out onto the surface along the shell structure, and therefore it is possible to improve the offset resistance.

Besides, in the present invention, by causing the shell part of the organic fine particles to contain an ionic functional group, it is possible to improve the chargeability.

Moreover, in the present invention, by neutralizing the ionic functional group of the organic fine particles, the organic fine particles swell, and therefore it is possible to promote fusion between the organic fine particles and the base particle and between the organic fine particles and improve the durability during long-time running. By controlling the particle size before neutralization to be 30 nm or larger, it is possible to improve the durability, and, by controlling the particle size before neutralization to be 300 nm or smaller, it is possible to improve the low-temperature fixing ability and transparency.

Further, in the present invention, by producing a toner by a soap-free emulsion polymerization method in which an emulsifier is immobilized in the organic fine particles, bleed to the toner surface is reduced, and it is possible to prevent a decrease in the charging stability under high temperature and high humidity conditions.

Additionally, in the present invention, by designing a resin so that the toner particle has a particle size not smaller than 1.02 times the particle size of the base particle, it is possible to increase the thickness of the surface layer formed by the organic fine particles and improve the durability and storage stability, and, by controlling the toner particle to have a particle size not larger than 1.10 times the particle size of the base particle, it is possible to prevent a decrease in the offset resistance due to reduction of the oozing effect of the releasing agent.

Besides, in the present invention, by neutralizing the cross-linked type fine particles having a core-shell structure with a neutralizer, the organic fine particles swell and dispersion ability appears, and, by using the organic fine particles with dispersion ability as a dispersing agent, it is possible to manufacture a toner with low-temperature fixing ability and high durability by simple processes because the organic fine particles form a uniform film on the surface of the base particle. Moreover, by reversely neutralizing the ionic functional group contained in the organic fine particles, it is possible to maintain environmental stability without the necessity of removing the dispersing agent.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A toner manufactured by attaching organic fine particles having a core-shell structure and a smaller particle size than a base particle to said base particle, wherein said organic fine particles are of cross-linked type and a cross-linking degree of the shell part of said organic fine particles is lower than a cross-linking degree of the core part thereof.

2. The toner of claim 1, wherein the shell part of said organic fine particles contains an ionic functional group.

3. The toner of claim 2, wherein the particle size of said organic fine particles is increased by 1.2 times or more by neutralizing the ionic functional group.

4. The toner of claim 2, wherein said organic fine particles have a particle size of 30 to 300 nm before neutralization.

5. The toner of claim 1, wherein said organic fine particles are produced by soap-free emulsion polymerization.

6. The toner of claim 1, wherein the toner has a particle size 1.02 to 1.10 times larger than that of said base particle.

7. A toner comprising:

a base particle; and cross-linked type organic fine particles attached to said base particle, said organic fine particles having a core-shell structure and a particle size smaller than said base particle, wherein a cross-linking degree of the shell part of said organic fine particles is lower than a cross-linking degree of the core part thereof.

8. A method of manufacturing a toner, comprising the steps of:

mixing cross-linked type organic fine particles having a core-shell structure, said organic fine particles having a cross-linking degree of the shell part which is lower than a cross-linking degree of the core part thereof, with a solution containing a neutralizer;

dispersing a composition for forming a base particle, which contains a releasing agent and a colorant, into the solution in which the organic fine particles are mixed; and separating the composition from the solution.

9. The manufacturing method of toner of claim 8, wherein the organic fine particles contain an ionic functional group, and, the method further comprises the step of reversely neutralizing the ionic functional group contained in the organic fine particles after dispersing the composition into the solution.

10. The manufacturing method of toner of claim 8, wherein the composition contains a monomer having an ethylenically unsaturated bond, and, the method further comprises the step of polymerizing the monomer by heating after dispersing the composition into the solution.

11. The manufacturing method of toner of claim 8, wherein the composition contains a binder.

12. The manufacturing method of toner of claim 8, wherein the composition has a kinematic viscosity of 100 St or less before dispersion.

* * * * *